US008192550B2

(12) United States Patent
Vernier

(10) Patent No.: US 8,192,550 B2
(45) Date of Patent: Jun. 5, 2012

(54) USE OF AN AQUEOUS NEUTRAL CLEANING SOLUTION AND METHOD FOR REMOVING ROUGING FROM STAINLESS STEEL SURFACES

(75) Inventor: Marc Philippe Vernier, Liestal (CH)

(73) Assignee: Ateco Services AG, Rheinfelden (CH)

( * ) Notice: Subject to any disclaimer, the term of this patent is extended or adjusted under 35 U.S.C. 154(b) by 169 days.

(21) Appl. No.: 12/565,376

(22) Filed: Sep. 23, 2009

(65) Prior Publication Data

US 2010/0078040 A1 Apr. 1, 2010

Related U.S. Application Data

(63) Continuation-in-part of application No. PCT/EP2009/051074, filed on Jan. 30, 2009.

(30) Foreign Application Priority Data

Feb. 1, 2008 (EP) ..... 08150974
Aug. 4, 2009 (EP) ..... 09167155

(51) Int. Cl.
*C23G 1/00* (2006.01)
*C23G 1/24* (2006.01)

(52) U.S. Cl. ..... 134/2

(58) Field of Classification Search ..... 134/2
See application file for complete search history.

(56) References Cited

U.S. PATENT DOCUMENTS

| | | | | |
|---|---|---|---|---|
| 2,488,832 | A | 11/1949 | Rossi | |
| 3,077,487 | A | 2/1963 | Ramsey et al. | |
| 3,297,580 | A | 1/1967 | Pitzer | |
| 4,082,683 | A * | 4/1978 | Galesloot | 510/367 |
| 4,610,728 | A | 9/1986 | Natesh et al. | |
| 4,789,406 | A * | 12/1988 | Holder et al. | 134/3 |
| 5,037,483 | A | 8/1991 | Dubin | |
| 5,587,142 | A * | 12/1996 | Horwitz et al. | 423/658.5 |
| 6,310,024 | B1 | 10/2001 | Gill et al. | |
| 6,887,597 | B1 | 5/2005 | Yang et al. | |
| 2007/0034606 | A1 * | 2/2007 | Dietsche et al. | 216/100 |

FOREIGN PATENT DOCUMENTS

| | | | |
|---|---|---|---|
| EP | A-0 129 194 | | 12/1984 |
| EP | A-0 313 335 | | 4/1989 |
| EP | 1043421 | A2 * | 10/2000 |
| EP | A-1 043 421 | | 10/2000 |
| EP | 1 300 368 | A | 4/2003 |
| EP | A-1 621 521 | | 2/2006 |
| FR | A-2 590 716 | | 5/1987 |
| FR | A-2 699 936 | | 7/1994 |
| GB | A-1 076 979 | | 7/1967 |
| WO | WO 91/17124 | A | 11/1991 |
| WO | WO 00/46423 | A | 8/2000 |
| WO | WO 01/42148 | A | 6/2001 |
| WO | WO 02/10326 | A | 2/2002 |
| WO | WO 2004/011587 | A1 | 2/2004 |

OTHER PUBLICATIONS

Mathiesen, et al., "Rouging of stainless steel in WFI systems—examples and present understanding", FORCE Technology Paper 07193, presented at NACE Corrosion 2007, Mar. 2007 XP002526053.

International Preliminary Report on Patentability PCT/EP2009/051074.

* cited by examiner

*Primary Examiner* — Michael Kornakov
*Assistant Examiner* — Douglas Lee
(74) *Attorney, Agent, or Firm* — Johnson, Marcou & Isaacs, LLC; F. Brent Nix

(57) ABSTRACT

The invention relates to a method for removing films and deposits from stainless surfaces, especially from stainless metallic surfaces such as they are used in process stations and production units in the pharmaceutical, food and biotechnological industries, and to an aqueous cleaning solution comprising a reducing agent, in particular dithionite and/or disulfite, and at least two different complexing agents, wherein one of these complexing agents is a compound comprising diacetic acid groups or a salt thereof, for removing rouging on surfaces of stainless steels that come into contact with media selected from the group of chromium/nickel and chromium/nickel/molybdenum steels in the neutral pH range.

29 Claims, No Drawings

USE OF AN AQUEOUS NEUTRAL CLEANING SOLUTION AND METHOD FOR REMOVING ROUGING FROM STAINLESS STEEL SURFACES

RELATED APPLICATIONS

This is a Continuation-in-part of PCT application PCT/EP2009/051074 filed Jan. 30, 2009 and also claims the benefit of European patent applications EP 08 15 0974.7 filed Feb. 1, 2008, and EP 09 16 7155.2 filed Aug. 4, 2009, the disclosures of which are incorporated herein by reference in their entirety.

FIELD OF THE INVENTION

The present invention relates to methods for removing surface changes occurring on the surfaces of stainless metallic materials in the form of films and deposits of iron oxides, in particular on stainless steel surfaces as they are frequently used in process stations and production units in the pharmaceutical, food and biotechnological industries, as well as to aqueous cleaning solutions comprising a reducing agent and a complexing agent for use in said methods.

BACKGROUND OF THE INVENTION

Process stations/production units which are used in the production and processing of pharmaceutical active ingredients, pharmaceutical galenical forms, biotechnologically produced active ingredients, foods, etc., and systems and units which are used in the production and distribution of these products, as well as systems and units which are operated with ultrapure water, purified water and ultrapure vapor, are usually made from stainless steels based on stainless steel alloys. Examples include: Mixing vats, recipient vessels, storage containers, fermenters, dryers, filling machines, autoclaves, sterilization vessels, freeze dryers, washing machines, CIP units, ultrapure water generators, ultrapure vapor generators, distribution lines for the media (purified water, ultrapure water, ultrapure vapor, products) etc.

Despite the use of high quality materials such as e.g. stainless steels (e.g. CrNiMo steels of grades AISI 316L, AISI316Ti, or AISI 904L), after a while, discolorations can usually be observed on the surfaces that come in contact with the media, which are also known as "rouging" in the pharmaceutical industry, and characteristic brown-red particles are carried to the final product or the final stage of the production unit.

A wide variety of surface changes can occur on stainless metallic surfaces. They are often precipitates of iron oxides which occur in the form of fine reddish-brown iron oxide or iron hydroxide particles and usually comprise Cr, Ni and Mo components. These particles are usually of a powdery consistency and therefore only adhere loosely to the surface. They can therefore easily wiped off mechanically, but often leave a visible discoloration of the metallic surface. Other manifestations of these surface changes occur in the form of adhering films or deposits which can no longer be removed mechanically but have to be subjected to a chemical treatment. These newly formed surface layers can exhibit a color spectrum of yellow, blue, red, brown and black.

In particular in the pharmaceutical and food processing industries, the occurrence of these surface changes holds the danger of undesired contamination with heavy metal particles that flake off and are distributed into other systems and thus negatively affect the purity and quality of the production and processing products.

Depending on the operating intensity and conditions, these surface changes can occur as early as a few months after a unit is first started up. In other cases, it may be years until such changes are first observed.

As far as the formation of the surface change known as "rouging" is concerned, there is at this point no hard scientific data. According to the prevailing opinion among experts at present, the rouging phenomenon is a selective destruction of the chromium oxide-rich passive layer in the stainless steel surface in contact with the media due to the formation of an iron oxide-rich corrosion layer, with an additional effect being the formation and distribution of corrosion particles in the system.

Said rouging is therefore characterized by the occurrence of a typical iron oxide or iron hydroxide layer on the surface of the stainless steel material wherein these typical haematite or magnetite layers comprise intercalated Cr, Ni and Mo which indicates a tendency of the stainless steel material to dissolve layer by layer. As a rule, the rouging layers have a thickness of 0.1 to 10 μm whereby only the thinner films are to be considered rouge contamination; more massive films, on the other hand, would more likely be rust contamination.

It has been shown that the changes described above increasingly appear in systems which are operated with ultrapure water, or media-conducting ultrapure water, or with ultrapure (water) vapor, with elevated temperatures apparently accelerating the process of surface changing. The formation of surface changes is also influenced by the atmospheric conditions prevalent in the various systems, the various media conditions (e.g. pH<7), the quality of the material (composition of the alloy) and the surface finish. Depending on the operating time and conditions, films/deposits of different thicknesses are foamed.

Apparently, what triggers the formation of rouge is a local depassivation of the chromium oxide protective layer of the stainless steel surfaces caused by the parameters mentioned above, triggered by the breakdown of said protective layer at discrete surface points as well as the lack of a sufficient amount of oxygen for repassivation.

This mechanism of local depassivation is promoted by the considerably reduced amount of dissolved oxygen in hot waters (WFI>70° C. or steam) as well as by a strongly increased capacity for ion dissolution due to the purity of said waters.

The elevated temperatures inter alia cause iron atoms to increasingly diffuse to the surface and to react with the oxygen present at the surface to form oxides and hydroxides.

In order to allow a trouble-free reconstruction of the chromium oxide-free passive layer and to reduce the risk of a carry-over of detaching heavy metal particles and the risk of contamination of the products manufactured at the process stations and production units, it is necessary to completely remove and dispose of the rouging and rouging contamination layers rich in iron oxide while at the same time taking care of the stainless steel surfaces.

These films/deposits therefore have to be removed periodically using mechanical or wet-chemical cleaning processes or combinations thereof.

Mechanical cleaning processes during which the particles adhering loosely to the surface are removed e.g. by wiping with a cloth are usually limited to easily accessible areas. Such processes are not suitable to remove more permanent discolorations as well adhering films and deposits.

Wet-chemical cleaning processes aim at chemically removing the films/deposits. For this purpose, cleaning solutions containing inorganic acids are used almost exclusively.

So far, cleaning processes based on neutral cleaning solutions, as they were occasionally suggested for the removal of rust deposits on pipe systems conducting cold or hot water and containers made from black steels, have not been considered for the removal of rouging on media-contacted stainless steel surfaces.

Such neutral cleaning solutions are e.g. described in U.S. Pat. No. 6,310,024, U.S. Pat. No. 5,587,142, U.S. Pat. No. 4,789,406 for cleaning boilers, instant water heaters, and the like, for the removal of rust and/or lime deposits.

EP 1 621 521 and EP 1 300 368 disclose the use of neutral cleaning agents for the removal of deposits from systems conducting cold water, in particular water supply equipment such as e.g. drinking water containers.

Rouging on media-contacted stainless steel surfaces of process stations and production units operated with ultrapure water has a different quality than the rust and lime deposits described in the above-mentioned prior art which are formed on surfaces made from black steels or non-metallic surfaces. In practical applications, the complete removal of rouging on stainless steel surfaces has been found to be extremely costly and difficult, which led to the conventional wisdom that the use of strong and highly concentrated mineral acids is absolutely necessary despite the numerous known disadvantages.

When handled improperly, the use of concentrated mineral acids can sometimes entail considerable danger, both with respect to its transport and to its use as a component of the cleaning solution itself. In addition to the corrosive and strongly caustic effect of an acid such as concentrated hydrochloric acid, sulfuric acid or phosphoric acid, its vapors can cause severe respiratory irritations as well.

Organic acids, e.g. oxalic acid and/or citric acid, are sometimes used for cleaning off films/deposits as well. However, organic acids do not possess the same solubilizing capacity as highly concentrated mineral acids so that often mixtures of organic and inorganic acids are used too. Sometimes, complexing agents, e.g. EDTA or NTA, are added to these acid mixtures. One major disadvantage of such acid mixtures lies in the fact that they do not specifically remove the films/deposits in the form of oxidic iron compounds, but also partly dissolve the heavy metals additionally present in the alloy of the stainless steel. Thus, when handled improperly, there is the danger that the surface of the process stations and production units is attacked and the surface properties are negatively affected. Moreover, these cleaning solutions usually have a high heavy metal content after use so that the solutions subsequently have to be disposed of in a costly and professional manner.

In order to compensate for these disadvantages, specific additives were added to the cleaning solutions used for rouging contamination in practical applications in order to alleviate the negative effects the concentrated mineral acids have on the stainless steel surfaces, and complex process management and control protocols were drawn up in order to ensure a minimal dwell time of the cleaning solution on the stainless steel surface in combination with a maximum cleaning effect, as it is e.g. described in the "Technical Bulletin" of the company Henkel (Essay No. 26/Rev, 00, 2003).

BRIEF DESCRIPTION OF THE INVENTION

It is therefore the object of the present invention to provide a simple and gentle process for the substantially complete removal of rouging based on oxidic iron compounds on surfaces of stainless metallic materials that come into contact with media, in particular surfaces of materials made from stainless chromium/nickel steels, especially stainless chromium/nickel/molybdenum steels, and especially stainless chromium/nickel and/or chromium/nickel/molybdenum steels of grades AISI 304 (*1.4301), AISI 304L (1.4307, 1.4306), AISI 316 (1.4401), AISI 316L (1.4404, 1.4435), AISI 316 Ti (1.4571) and AISI 904L (1.4539) [*1.xxxx=according to DIN 10027-2], which can easily be controlled, but in particular a process for removing surface changes occurring on the surfaces of process stations and production units made from the above-mentioned materials, in particular process stations and production units operated with ultrapure water, ultrapure water in contact with media or ultrapure (water) vapor and used e.g. in the pharmaceutical, food and biotechnological industries, which overcome the known disadvantages of the main processes currently being used.

This problem could surprisingly be solved by the use of neutral aqueous cleaning solutions comprising a reducing agent in combination with at least one complexing agent which allow an application in the neutral pH range.

In a specific embodiment, the present invention relates to a process for the substantially complete removal of rouging based on oxidic iron compounds on surfaces, in particular on surfaces of stainless metallic materials that come into contact with media, in particular surfaces of materials made from stainless chromium/nickel steels that come into contact with media, especially stainless chromium/nickel/molybdenum steels, and especially stainless chromium/nickel and/or chromium/nickel/molybdenum steels of grades AISI 304 (*1.4301), AISI 304L (1.4307, 1.4306), AISI 316 (1.4401), AISI 316L (1.4404, 1.4435), AISI 316 Ti (1.4571) and AISI 904L (1.4539) [*1.xxxx=according to DIN 10027-2].

Thus, the present invention relates to a process for the substantially complete removal of surface changes based on rouging on stainless metallic materials, in particular stainless metallic materials that come into contact with media, in particular materials made from stainless chromium/nickel steels of the above-mentioned grades, which is characterized in that said surfaces are treated with an aqueous solution comprising a reducing agent, in particular dithionite and/or disulfite, and at least one, particularly at least two different complexing agents in the neutral pH range, as well as said cleaning solutions for use in such a process. One of these complexing agents is preferably a compound comprising diacetic acid groups or a salt thereof, in particular a compound selected from the group consisting of taurine diacetic acid, hydroxyethylimino diacetic acid, alanine diacetic acid, methylglycine diacetic acid, glutamine diacetic acid, asparagine diacetic acid, serine diacetic acid, but in particular methylglycine diacetic acid or a salt thereof.

The present invention also encompasses a process for the repassivation of selectively destroyed passive layers rich in chromium oxide on stainless steel surfaces, in particular on stainless steel surfaces that come into contact with media, which is characterized in that the rouging deposits formed on these surfaces are treated with an aqueous solution comprising a reducing agent, in particular dithionite and/or disulfite, and at least one complexing agent at neutral pH values and said deposits are completely removed, and that subsequently the surface is treated with an aqueous solution comprising an oxidizing agent and preferably at least one complexing agent which is capable of building up the passive layer protecting the stainless steel. One of these complexing agents is preferably a compound comprising diacetic acid groups or a salt thereof, in particular a compound selected from the group consisting of taurine diacetic acid, hydroxyethylimino diacetic acid, alanine diacetic acid, methylglycine diacetic acid, glutamine diacetic acid, asparagine diacetic acid, serine diacetic acid, but in particular methylglycine diacetic acid or a salt thereof.

The present invention is furthermore directed to a process for preventing the contamination of production and processing products manufactured in process stations and production units made from stainless metallic materials, in particular stainless steels, in particular stainless chromium/nickel steels, especially stainless chromium/nickel/molybdenum steels, and especially stainless chromium/nickel and/or chromium/nickel/molybdenum steels of grades AISI 304 (*1.4301), AISI 304L (1.4307, 1.4306), AISI 316 (1.4401), AISI 316L (1.4404, 1.4435), AISI 316 Ti (1.4571) and AISI 904L (1.4539) [*1.xxxx=according to DIN 10027-2], however, preferably in process stations and production units operated with ultrapure water, ultrapure water in contact with media or ultrapure (water) vapor, particularly at elevated temperatures in the range of 40° C. to 90° C., especially in a range of 50° C. to 85° C. Said contamination is caused by particles or components, in particular particles and components comprising oxidic iron compounds, which detach from the altered surface and are then able to travel through the process stations and production units as well as the systems connected thereto. The process according to the present invention is particularly characterized in that said process stations and production units are treated with the cleaning solution according to the present invention as defined above, the deposits are removed from the treated surfaces and dissolved and then removed from the system together with the cleaning solution.

The present invention furthermore relates to the use of the aqueous cleaning solution according to the present invention as defined above for removing rouging deposits on surfaces, in particular surfaces that come into contact with media, of stainless steels selected from the group of chromium/nickel and chromium/nickel/molybdenum steels in the neutral pH range, in particular in a pH range of about pH 4.5 to about pH 9.0, especially about pH 6.0 to about pH 8.0, and especially about pH 6.5 to about pH 7.5. Said rouging deposits usually have a layer thickness between 0.1 μm and 10 μm, in particular between 0.4 μm and 0.8 μm.

In a specific embodiment of the use according to the present invention and described herein, said rouging deposit comprises iron oxide and/or iron hydroxide layers with intercalated Cr and/or Ni and/or Mo, wherein said oxidic iron compounds are oxidically bound iron, in particular Fe(II), Fe(III) and/or Fe(II)/Fe(III) oxides or hydroxides with Cr, Ni and/or Mo components.

In another specific embodiment of the use according to the present invention and described herein, the steels to be cleaned are steels of grades AISI 304 (*1.4301), AISI 304L (1.4307, 1.4306), AISI 316 (1.4401), AISI 316L (1.4404, 1.4435), AISI 316 Ti (1.4571) and AISI 904L (1.4539). [*1.xxxx=according to DIN 10027-2], wherein said steels can be cold-rolled, polished, scoured or electropolished steels, especially steels with a surface roughness of Ra<3.0 μm.

In another specific embodiment of the use according to the present invention and described herein, the steels to be cleaned are steels whose surfaces are exposed to ultrapure water or ultrapure water or ultrapure (water) vapor conducting containing media, or ultrapure (water) vapor, wherein said ultrapure water is a. purified water (Aqua Purificata (AP)) with a conductivity of ≦4.3 μS at 20° C. (Ph. Eur.) or ≦4.7 μS at 25° C. (USP 25);
b. ultrapurified water (Aqua valde purificata) with a conductivity of ≦2.1 μS at 25° C.;
c. water for injection (Aqua ad iniectabilia) with a conductivity of ≦1.1 μS at 20° C. (Ph. Eur.) or ≦1.3 μS at 25° C. (USP 25)

and said ultrapure (water) vapor has a conductivity of ≦5.0 μS.

In another specific embodiment of the use according to the present invention and described herein, the cleaning solution comprises a reducing agent, in particular dithionite and/or disulfite, and at least two different complexing agents and optionally an additional substance having both complexing and reducing properties, such as e.g. oxalic acid or one of its salts. One of these complexing agents is preferably a compound comprising diacetic acid groups or a salt thereof, in particular a compound selected from the group consisting of taurine diacetic acid, hydroxyethylimino diacetic acid, alanine diacetic acid, methylglycine diacetic acid, glutamine diacetic acid, asparagine diacetic acid, serine diacetic acid, but in particular methylglycine diacetic acid or a salt thereof.

Another object of the present invention is therefore an aqueous cleaning solution for the use in a process for removing rouging deposits on surfaces of stainless steels that come into contact with media selected from the group of chromium/nickel and/or chromium/nickel/molybdenum steels, in particular steels of the above-mentioned grades, in the neural pH range, characterized in that said cleaning solution comprises a reducing agent, in particular dithionite and/or disulfite, and at least two different complexing agents, and optionally an additional substance having both complexing and reducing properties, such as e.g. oxalic acid or one of its salts. One of these complexing agents is preferably a compound comprising diacetic acid groups or a salt thereof, in particular a compound selected from the group consisting of taurine diacetic acid, hydroxyethylimino diacetic acid, alanine diacetic acid, methylglycine diacetic acid, glutamine diacetic acid, asparagine diacetic acid, serine diacetic acid, but in particular methylglycine diacetic acid or a salt thereof.

In a specific embodiment, a salt-like reducing oxygen compound is used as reducing agent, in particular a reducing oxygen compound selected from the group of sulfur, nitrogen and phosphorus oxygen compounds, in particular a reducing sulfur oxygen compound such as e.g. dithionite or disulfite.

In another embodiment of the invention, an acid selected from the group of phosphonic acids, phosphonocarboxylic acids, hydroxyl acids, iminosuccinylic acids, acetic acids and citric acids or a salt thereof is used as complexing agent, in particular a phosphonic acid selected from the group of hydroxyalkanoic and alkylenephosphonic acids, in particular 1-hydroxyethane-1,1-diphosphonic acid (HEDP), aminotri (methylenephosphonic acid) (ATMP), hexamethylenediaminotetra(methylenephosphonic acid) (HDTMP), diethylenetriaminopenta(methylenephosphonic acid) (DTPMP) or a salt thereof, or 2-phosphono-butane-1,2,4-tricarboxylic acid or a salt thereof.

In another specific embodiment, an iminosuccinylic acid or a salt thereof is used as complexing agent, in particular iminodisuccinylic acid or a salt thereof.

The concentrations of the reducing agent and the complexing agent in the cleaning solution according to the present invention lie in the range of 0.1 wt.-% to 1 wt.-%, in particular in a range of 0.2 wt.-% to 0.8 wt.-%.

In another specific embodiment of the present invention, the inventive use described herein of an aqueous cleaning solution comprising a reducing agent and at least one complexing agent for preventing the contamination of production and processing products manufactured in process stations and production units operated with ultrapure water, ultrapure water in contact with media or ultrapure (water) vapor, in particular contamination caused by particles or components, in particular particles and components comprising oxidic iron compounds, which detach from the altered surface, takes place in a process characterized in that said process stations and production units are treated with an aqueous cleaning solution comprising a reducing agent and at least one complexing agent, the deposits are removed from the treated surfaces and dissolved and then removed from the system together with the cleaning solution.

DETAILED DESCRIPTION OF THE INVENTION

In the following, certain terms used in the present invention are explained in more detail.

Within the framework of the present invention, the use of the singular forms "a" and "the" is also intended to encompass plural aspects, unless the general context calls for a different interpretation. Thus, when reference is for example made to "a compound", "a reducing agent", "a complexing agent", etc., the use of two or more compounds, two or more reducing agents, two or more complexing agents, etc., is encompassed as well.

The term "media" as used in the present invention refers, in the widest sense of the word, to ultrapure water as well as to reaction solutions, nutrient solutions and/or other aqueous media-containing solutions that conduct media, prepared using ultrapure water, as they are used in process stations and production units used in the production and processing of pharmaceutical active ingredients, pharmaceutical galenical fauns, biotechnologically produced active ingredients, foods, etc.

Within the framework of the present invention, "ultrapure water" refers to highly purified waters having a conductivity in the range of ≦1.0 μS and ≦5.0 μS measured at a temperature between 20° C. and 25° C. In particular, ultrapure water refers to:

a. purified water (Aqua Purificata (AP)) with a conductivity of ≦4.3 μS at 20° C. (Ph. Eur.) or ≦4.7 μS at 25° C. (USP 25);
b. ultrapurified water (Aqua valde purificata) with a conductivity of ≦2.1 μS at 25° C.;
c. water for injection (Aqua ad iniectabilia) with a conductivity of ≦1.1 μS at 20° C. (Ph. Eur.) or ≦1.3 μS at 25° C. (USP 25)

"Ultrapure vapor" or "ultrapure (water) vapor" refers to water vapor which is, inter alia, used for sterilization purposes, prepared by distilling processed drinking water with a conductivity of ≦5.0 μS at 25° C., or Aqua Purificata (AP) with a conductivity of ≦2.1 μS at 25° C. or ≦4.7 μS at 25° C. (USP 25), or ultrapurified water (Aqua valde purificata) with a conductivity of ≦2.1 μS at 25° C., or WFI (water for injection) with a conductivity of ≦1.1 μS at 20° C. (Ph. Eur.) or ≦1.3 μS at 25° C. (USP 25), and which ultrapure (water) vapor has a conductivity of ≦5.0 μS.

The term "surface changes" as used in the present invention in the most general sense refers to any and all structural changes of stainless metallic surfaces, in particular the surfaces of stainless steels, in particular stainless steels selected from the group of chromium/nickel and/or chromium/nickel/molybdenum steels, especially steels of grades AISI 304 (*1.4301), AISI 304L (1.4307, 1.4306), AISI 316 (1.4401), AISI 316L (1.4404, 1.4435), AISI 316 Ti (1.4571) and AISI 904L (1.4539) [*1.xxxx=according to DIN 10027-2], which are based on changes in the passive layer of said surfaces so that new layers rich in iron oxide can form on the metallic surface which, in contrast to an intact passive layer, usually leads to discolorations.

In particular, these steels are cold-rolled, polished, scoured or electropolished steels of the mentioned grades with a surface roughness of Ra<3.0 μm.

Stainless steels of these grade, however, especially CrNi or CrNiMo steels of grades AISI 304 (*1.4301), AISI 304L (1.4307, 1.4306), AISI 316 (1.4401), AISI 316L (1.4404, 1.4435), AISI 316 Ti (1.4571) and AISI 904L (1.4539) [*1.xxxx=according to DIN 10027-2] are first and foremost used in apparatus construction for the chemical industry and textile finishing, the food processing industry, as well as transport and storage vessels for aggressive media, paper stock units, devices for photo developing, etc.

In a more specific embodiment, in particular in connection with stainless Cr/Ni steels and/or CrNiMo steels, the term "surface changes" refers to structural changes of the chromium oxide-rich passive layer of the metallic surface which are due to the fact that the Cr/Fe ratio is reduced to the disadvantage of the chromium content which allows the iron to build up a new additional layer rich in iron oxide.

In contrast to an intact passive layer, this new surface rich in iron oxide is usually easily visible due to discolorations wherein the color spectrum includes yellow, orange, red, beige, brown, and gray to black; however, sometimes it is not visible until the surface has been wiped mechanically.

Within the framework of the present invention, the terms "oxidic iron" or "oxidic iron compounds" refer to iron(III) oxides, iron(II,III)oxides and iron(II)oxides such as e.g. $Fe_2O_3$, $Fe_3O_4$, FeO, as well as iron hydroxides or iron(III) oxide hydrates. The latter is a group of substances that can be derived from iron(III)oxide and exhibit a different hydration. In this connection, examples include $Fe_2O_3 3H_2O$, $2Fe_2O_3 3H_2O$, $Fe_2O_3 2H_2O$ and $Fe_2O_3 H_2O$.

The surface changes occurring on said stainless metallic materials are mostly precipitates of oxidic iron compounds which can occur in the form of fine red-brown iron oxide or iron hydroxide particles or in the form of adhering films or deposits wherein the oxidic iron present in said particles, films or deposits is usually present in the form of poorly soluble Fe(III). In contrast to the particulate surface changes present in a powdery consistency, which can easily be removed mechanically, e.g. by wiping, the above-mentioned films and deposits are permanent adhering surface changes which can no longer be removed mechanically. These newly formed surface layers can exhibit a color spectrum of yellow, blue, red, brown and black.

The above-mentioned surface changes in particular include the films and deposits containing oxidic iron oxides on stainless metallic surfaces known under the catchword "rouging", in particular on the surfaces of stainless steels, such as e.g. CrNi or CrNiMo steels, especially on stainless surfaces of CrNiMo steels of grades AISI 304 (*1.4301), AISI 304L (1.4307, 1.4306), AISI 316 (1.4401), AISI 316L (1.4404, 1.4435), AISI 316 Ti (1.4571) and AISI 904L (1.4539). [*1.xxxx=nach DIN 10027-2], as can be found in process stations and production units and systems operated with ultrapure water or ultrapure vapor and used in particular in the pharmaceutical and food processing industries.

In the present invention, the terms "rouging", "rouging film" and "rouging deposit" are used synonymously. "Rouging" refers to a special form of oxidic deposits that occur on stainless steel surfaces, in particular on surfaces made from austenitic stainless steel alloys in hot WFI systems or in ultrapure vapor systems, which typically comprise iron oxide- or iron hydroxide-dominated layers which typically comprise intercalated Cr, Ni and Mo or their oxides. These porous and particle-forming rouging layers rich in iron oxide, which usually have a layer thickness between 0.1 μm and 10 μm and whose nature is that of a flat corrosion, replace the originally present dense and strong passive layers rich in chromium oxide. In this connection, only the thinner films constitute rouging contamination while the more massive films, which can also be observed, correspond more to rust contamination and represent a secondary occurrence independent of the actual rouging phenomenon.

The substances forming the rouging films or deposits are mostly iron oxides (FeO, $Fe_2O_3$) or iron hydroxides, such as e.g. $Fe(OH)_2$ or $Fe(OH)_3$.

The formation of the typical "rouging" films or deposits on stainless steel surfaces is closely linked to and thus dependent on the materials used and the thermodynamic conditions to which these materials are exposed.

"Rouging" almost exclusively occurs on the surfaces of materials made from stainless chromium/nickel steels, in particular stainless chromium/nickel/molybdenum steels, especially stainless chromium/nickel/molybdenum steels of grades AISI 304 (*1.4301), AISI 304L (1.4307, 1.4306), AISI 316 (1.4401), AISI 316L (1.4404, 1.4435), AISI 316 Ti (1.4571) and AISI 904L (1.4539) [*1.xxxx=according to DIN 10027-2], and under conditions which promote a local depassivation of the chromium oxide protective layer on said surfaces.

They include, for example, the presence of ultrapure water and/or ultrapure vapor at a temperature of >70° C. and a pH value of <7.

Especially persistent and difficult to remove deposits occur when the following water and vapor qualities are used:

a. purified water (Aqua Purificata (AP)) with a conductivity of ≦4.3 μS at 20° C. (Ph. Eur.) or ≦4.7 μS at 25° C. (USP 25);
b. ultrapurified water (Aqua valde purificata) with a conductivity of ≦2.1 μS at 25° C.;
c. water for injection (Aqua ad iniectabilia) with a conductivity of ≦1.1 μS at 20° C. (Ph. Eur.) or ≦1.3 μS at 25° C. (USP 25)
d. ultrapure (water) vapor prepared by distilling processed drinking water with a conductivity of ≦5.0 μS at 25° C. or ultrapure water according to a.) to c.).

As a "reducing agent", in particular those compounds are used which have a redox potential sufficiently high to reductively dissolve the surface changes, but in particular a redox potential which is sufficient for converting the Fe(III) oxidically bound in the surface changes to soluble Fe(II). In a specific embodiment of the present invention, compounds are used as reducing agent which have a redox potential in the range of −0.4 E°/V to −2.0 E°/V, in particular −0.5 E°/V to −1.5 E°/V, in particular −0.6 E°/V to −1.2 V, in particular −0.7 E°/V to −1.0 E°/V, based on the normal hydrogen electrode measured in a concentration of 1 mole/liter and at a temperature of 25° C.

All individual numerical values that fall in the above range of −0.4 E°/V to −2.0 E°/V but are not explicitly mentioned here, are also intended to be encompassed by the subject-matter of the present invention.

In a specific embodiment of the process according to the present invention, a salt-like reducing oxygen compound is used as reducing agent in the cleaning solution, in particular a salt-like reducing inorganic oxygen compound, in particular a compound selected from the group of sulfur, nitrogen and phosphorus oxygen compounds.

Examples of such inorganic reducing sulfur oxygen compounds include, in particular, sulfite, bisulfite and dithionite, as well as salts thereof, in particular their sodium salts.

Known commercially available compounds can be used as "complexing agents" which are capable of complexing iron ions, in particular iron(II) ions in solution and which are furthermore inert towards the effect of the reducing agent contained in the cleaning solution, or exhibit a sufficiently high short-term stability with regard to said reducing agent so that they can fulfill their function as complexing agent for the time period required for cleaning.

Examples of such complexing agents which can be used in a specific embodiment of the process according to the present invention include acids selected from the group of phosphonic acids, hydroxyl acids, carboxylic acids, iminosuccinylic acids, acetic acids and citric acids or a salt thereof.

The present invention is based on the surprising finding that a combined use of compounds serving as reducing agents or complexing agents in an aqueous cleaning solution allows the complete removal of surface changes on stainless metallic materials. In particular, said surface changes are oxidic iron compounds which form on metallic surfaces, especially on metallic surfaces of stainless materials. Said stainless materials are in particular stainless steels, especially stainless steels of a Cr—Ni grade, in particular a Cr—Ni—Mo grade which, due to their molybdenum content, exhibit good corrosion resistance as well as improved mechanical properties at high temperatures compared to other steel grades without molybdenum.

According to the present invention, reducing agents, in particular inorganic reducing agents, are used in the cleaning solutions suitable for removing said surface changes, which in neutral aqueous solution exhibit a high solubilizing capacity with respect to oxidic iron compounds, in particular with respect to oxidic iron compounds of poorly soluble oxidic trivalent Fe(III).

In general, compounds can be used as reducing agents within the framework of the present invention which are capable of converting the multivalent insoluble oxidic metals present in the above-mentioned surface changes, especially oxidic trivalent Fe(III), to more soluble forms such as e.g. Fe(II), in as far as such compounds can be used in view of legal regulations regarding water quality. Said reducing agents in particular have a redox potential in the range of about −0.4 E°/V to −2.0 E°/V, in particular −0.5 E°/V to −1.5 E°/V, in particular −0.6 E°/V to −1.2 V, in particular −0.7 E°/V to −1.0 E°/V, based on the normal hydrogen electrode measured in a concentration of 1 mole/liter and at a temperature of 25° C.

In a specific embodiment of the present invention, salt-like inorganic reducing oxygen compounds are used as inorganic reducing agents, including, without being limited thereto, a reducing oxygen compound selected from the group of sulfur, nitrogen and phosphorus oxygen compounds.

In particular, nitrite can be mentioned as an example of inorganic reducing nitrogen oxygen compounds. Hydrazine can also be used as reducing agent.

In another specific embodiment of the present invention, reducing sulfur oxygen compounds are in particular used as reducing agents, such as e.g. dithionite and/or disulfite and/or sulfite and/or bisulfite and/or thiosulfate. The mainly Fe(III)-containing films/deposits are converted into Fe(II) which is easier to complex by reducing the Fe(III) and dissolved and/or converted into colorless crusts which are easier to burst off than the original films/deposits.

Within the framework of the present invention it has been shown that especially dithionite and disulfite (pyrosulfite) or mixtures of these compounds in neutral aqueous solutions exhibit a high solubilizing capacity with respect to oxidic iron compounds.

Thus, dithionite solutions and disulfite solutions and mixtures of these solutions are similarly effective as mixtures of hydrochloric acid and inhibitors or other inorganic or organic acids. However, due to the pH neutral application option and their reducing nature, the agents according to the present invention can also be used for the treatment of stainless steels without limitations. Thus, the agents according to the present invention gently remove films of oxidic iron compounds from metallic surfaces made from stainless steel as they are used e.g. in process stations and production units including pipes or vessel surfaces which significantly increases their operating life and function.

This is also a concern for the surfaces of non-metallic components of said process stations and production units, such as e.g. valves, seals, etc. which due to carry-over can also show deposits of oxidic iron compounds.

Furthermore, the dangers during transport and use of the cleaning solution according to the present invention or its components are considerably lower than with the use of hydrochloric acid and/or other inorganic or organic acids. The sulfate product of the reaction with the oxidic iron compounds is toxicologically and ecologically unproblematic. Dithionite and pyrosulfite can be purchased inexpensively as technical chemicals, inter glia in the form of sodium dithionite or sodium disulfite (sodium pyrosulfite) and their application is therefore economical as well.

Furthermore, salts of reducing acidic nitrogen oxygen compounds, e.g. nitrite, or reducing acidic phosphor oxygen compounds, e.g. phosphite or hydrophosphite, can also be used as possible substitutes for the reducing sulfur oxygen compounds dithionite and disulfite during the process according to the present invention. Hydrazine can also be used as reducing agent.

Therefore, in a specific embodiment of the present invention, a dithionite or disulfite or a combination of dithionite and disulfite is used as an inorganic reducing agent in the cleaning solution.

It has furthermore been shown that the effect of the reducing agent, i.e. in particular the dithionite/disulfite, with respect to removing the iron oxide films/deposits, is improved if in addition one or more complexing agents are added to the cleaning solution.

The invention is furthermore directed to the use of certain complexing agents, which are known per se, capable of forming complexes with higher-valent metal ions, in particular Fe(III) and especially Fe(II).

The complexing agents suitable for use in the present invention should furthermore be inert towards the reducing effect of the reducing agents present in the treatment solution under the prevailing conditions or exhibit a sufficiently high short-term stability with regard to said reducing agents so that they can fulfill their function as complexing agent for the treatment period.

It can therefore be advantageous to add the complexing agent to the cleaning solution later than the reducing agent, namely at a point in time when part of the oxidically bound metals has already been dissolved out of the surface changes by the reducing agent and converted to a form suitable for the complexing agent.

In a special embodiment of the present invention, the complexing agent is therefore added to the cleaning solution at a later point when the treatment has already started, in particular at least 10 minutes, preferably at least 20 minutes, more preferably at least 30 minutes and up to 1 hour after beginning the treatment.

Alternatively, the complexing agent can also be replaced with the addition of fresh complexing agent during the cleaning process when it has been used up or lost some of its effectiveness due to the effect of the reducing agent.

Examples of such complexing agents which can be used in a specific embodiment of the process according to the present invention include acids selected from the group of phosphonic acids, hydroxyl acids, carboxylic acids, iminosuccinylic acids, acetic acids and citric acids or a salt thereof.

Complexing agents suitable for use in the process according to the present invention include, for example, compounds having phosphonic acid groups, optionally in the form of a salt, such as e.g. hydroxyalkanephosphonic acids or a salt thereof, in particular 1-hydroxyethane-1,1-diphosphonic acid (HEDP), or an alkylenephosphonic acid, in particular aminotri(methylenephosphonic acid) (ATMP), hexamethylenediaminotetra-(methylenephosphonic acid) (HDTMP), or diethylenetriaminopenta(methylenephosphonic acid) (DTPMP) and/or compounds comprising succinylic acid groups, optionally in the form of a salt, such as e.g. iminosuccinylic acid and in particular iminodisuccinylic acid.

The use of the per se known complexing agents of the phosphonic acid type for the removal of films and deposits on stainless surfaces in pharmaceutical, food processing and biotechnological units is advantageous in that the complexing agents are safe as far as toxicity is concerned.

Further examples of compounds suitable for the use as complexing agents within the framework of the present invention include, without being limited thereto, compounds of the hydroxy(poly)carboxylic acid type, in particular hydroxypolycarboxylic acids with 2 to 4 carboxy groups such as e.g. citric acid, tartaric acid or malic acid or a salt thereof.

Compounds of the acetic acid type can be used as well, in particular di-, tri- or tetraacetic acids, but in particular an isorin-N,N-diacetic acid (ISDA), ethylenediaminetetraacetic acid (EDTA), propylenediaminetetraacetic acid (PDTA), nitrilotriacetic acid (NTA) or a salt thereof.

Thus, in another specific embodiment, said complexing agent is a carboxylic acid, in particular an aminocarboxylic acid or phosphonocarboxylic acid, in particular a phosphonotricarboxylic acid, in particular a phosphonobutanetricarboxylic acid such as e.g. a 2-phosphonobutane-1,2,4-tricarboxylic acid or a salt thereof.

Furthermore, sodium citrate or ethanoldiglycine can be used as complexing agent in the process according to the present invention.

The salts that can be used in the cleaning solutions described above are mainly the alkali salts of the above-mentioned acids, in particular their lithium, sodium, potassium, rubidium and cesium salts, and in particular their sodium and potassium salts.

The presence of the complexing agents prevents that the reaction of the oxidic iron and the reducing agent leads to the formation of crusts. It has been shown that the complexing agents significantly improve the detachment process of the components of the oxidic iron from the stainless metal surface. Therefore, within the framework of the present invention, a cleaning solution is preferably used which comprises a combination of a reducing agent and at least one, but especially two or more complexing agents belonging to different classes of substances, as well as optionally a buffer.

In another embodiment of the present invention, said aqueous cleaning solution can also comprise additional components selected from the group of buffer salts, wetting agents, stabilizers and/or additional reducing agents which can be present in dissolved or emulsified form or as a suspended solid.

The process according to the present invention is carried out in a pH range of about 4.0 to about 10.0, in particular about 4.5 to about 9.5, especially about 6.0 to about 8.0, and especially about 6.5 to about 7.5.

In order to keep the pH value of the cleaning solution constant in the desired range, buffers are usually added to the cleaning solution, in particular buffers on the basis of harmless salts of weak mineral acids. Suitable buffer systems for adjusting a desired pH value can be inferred from relevant chemical reference books. For adjusting a neutral pH value, the system hydrogen carbonate/carbonic acid is especially suitable. However, other buffer systems can be used as well.

It has furthermore been shown that the effect of an aqueous cleaning solution comprising a reducing agent, i.e. in particular dithionite or disulfite or a combination of dithionite or disulfite, and at least one, in particular, however, at least two, complexing agents, i.e. in particular compounds of the phosphonate or succinate type, is improved as far as the gentle removal of the iron oxide films/deposits from stainless metallic surfaces is concerned, if carboxylic acids and/or salts thereof are added to the cleaning solution as well, such as e.g. oxalic acid and/or a salt thereof. The additional use of such carboxylic acids and/or salts thereof enhances the removal of oxidic iron compounds on the stainless surfaces to be treated since these carboxylic acids and/or carbonates can have both complexing and reducing effects.

The chemical components necessary for carrying out the process according to the present invention can be introduced into the cleaning solution in any desired suitable form, i.e. as separate or mixed solids, as solutions or concentrates, or as pastes and gels. The cleaning solution can be prepared prior to contacting the deposits to be treated, but the cleaning solution can also be prepared in situ in the units to be treated, e.g. in a production vessel or a pipe system, by adding the individual components at different times.

This alternative has to be kept in mind if a two-stage process is planned wherein in a first stage, the reduction stage, the surface changes are treated with a first cleaning solution I comprising the reducing agent, and in a second stage, a complexing stage, a treatment with a second cleaning solution II is carried out which comprises at least one complexing agent capable of entering into a soluble complex compound with the divalent iron ions. Alternatively, the complexing agent can also be added directly or later on in situ to the cleaning solution I.

As was stated above, the reducing agent and the complexing agent can be added to the cleaning solution before use or in situ; they are present in the cleaning solution at a concentration ranging from 0.025 wt.-% to 25 wt.-%, in particular at a concentration ranging from 0.05 wt.-% to 15 wt.-%, in particular at a concentration ranging from 0.1 wt.-% to 10 wt.-%, in particular at a concentration ranging from 0.2 wt.-% to 5 wt.-%, in particular at a concentration ranging from 0.25 wt.-% to 1 wt.-%, in particular at a concentration ranging from 0.25 wt.-% to 0.5 wt.-% in particular at a concentration ranging from 0.5 wt.-% to 1.5 wt-%.

It has been shown that especially good cleaning performance can be achieved if the reducing agent and the complexing agent are present in the cleaning solution at a concentration ratio of 6% reducing agent/10% complexing agent, in particular at a concentration ratio of 5% reducing agent/8% complexing agent, in particular at a concentration ratio of 3% reducing agent/5% complexing agent, in particular at a concentration ratio of 1.5% reducing agent/2.5% complexing agent, in particular at a concentration ratio of 0.6% reducing agent/1% complexing agent, in particular at a concentration ratio of 0.5% reducing agent/0.8% complexing agent in particular at a concentration ratio of 0.3% reducing agent/0.5% complexing agent, in particular at a concentration ratio of 0.15% reducing agent/0.25% complexing agent, in particular at a concentration ratio of 0.1% reducing agent/0.2% complexing agent.

In a specific embodiment of the present invention, a cleaning solution is used which comprises a reducing agent, such as e.g. dithionite or disulfite or a combination of dithionite or disulfite or a salt thereof, and at least one, but preferably two complexing substances, such as e.g. phosphonic acid and/or a compound comprising succinylic acid groups, preferably diacetic acid groups, or a salt thereof. In cleaning solutions comprising at least two complexing substances, they are preferably two chemically different substances.

In another specific embodiment of the present invention, a cleaning solution is used which comprises dithionite or disulfite or a combination of dithionite or disulfite or a salt thereof as inorganic reducing agent and a phosphonic acid and a compound comprising succinylic acid groups, preferably diacetic acid groups, or a salt thereof as complexing agent.

In another specific embodiment of the present invention, a cleaning solution is used which comprises dithionite or disulfite or a combination of dithionite or disulfite or a salt thereof as inorganic reducing agent and a phosphonic acid and a compound comprising diacetic acid groups, such as e.g. taurine diacetic acid, hydroxyethylimino diacetic acid, alanine diacetic acid, methylglycine diacetic acid, glutamine diacetic acid, asparagine diacetic acid, serine diacetic acid, but in particular methylglycine diacetic acid or a salt thereof, as complexing agent.

In another specific embodiment, the cleaning solution is comprised of dithionite or a salt thereof and a combination of phosphonic acid and iminosuccinylic acid or a salt thereof, and optionally a buffer.

In another specific embodiment, the cleaning solution is comprised of dithionite or a salt thereof and a combination of phosphonic acid and iminosuccinylic acid, in particular methylglycine diacetic acid, or a salt thereof, as well as oxalic acid or a salt thereof, and optionally a buffer.

In another specific embodiment, the cleaning solution is comprised of dithionite or a salt thereof and a combination of phosphonic acid and methylglycine diacetate or a salt thereof, and optionally a buffer.

In another specific embodiment, the cleaning solution is comprised of dithionite or a salt thereof and a combination of phosphonic acid and methylglycine diacetate or a salt thereof, as well as oxalic acid or a salt thereof, and optionally a buffer.

In another specific embodiment, the cleaning solution is comprised of a combination of formulations A and B as listed in the examples.

In particular, the above-mentioned phosphonic acid is a phosphonobutanetricarboxylic acid or a salt thereof, and the iminosuccinylic acid is an iminodisuccinylic acid or a salt thereof.

In another specific embodiment, the reducing agent and the complexing agent are present at a concentration ratio of 0.7% reducing agent/1.0% complexing agent, in particular at a concentration ratio of 0.3% reducing agent/0.5% complexing agent, if the cleaning solution only comprises one complexing agent, or at a concentration ratio of 3% reducing agent/8% complexing agent, in particular at a concentration ratio of 0.5% reducing agent/1.5% complexing agent, in particular at a concentration ratio of 0.6% reducing agent/1.1% complexing agent, in particular at a concentration ratio of 0.25% reducing agent/0.75% complexing agent in particular at a concentration ratio of 0.3% reducing agent/0.6% complexing agent, if the cleaning solution comprises two different complexing agents.

In another specific embodiment, the cleaning solution can additionally comprise between 0.01% and 0.5%, in particular between 0.04% and 0.2%, in particular between 0.05% and 0.1% of a compound with both complexing and reducing properties.

The treatment of the films and deposits containing oxidic iron compounds on stainless metallic surfaces, in particular on surfaces of stainless steels, is preferably carried out in a temperature range of about 20° C. to about 98° C., in particular in a temperature range of about 40° C. to about 90° C., in particular in a temperature range of about 50° C. to about 80° C., in particular in a temperature range of about 60° C. to about 85° C., in particular in a temperature range of about 70° C. to about 80° C., and at a pH value of about 4.0 to about 10.0, in particular from about 4.5 to about 9.5, in particular from about 6.0 to about 8.0, in particular from about 6.5 to about 7.5.

In a specific embodiment, the process according to the present invention is set up such that depending on the thickness and extent of the deposits, the stainless metallic surfaces, in particular the surfaces of stainless steels, remain in contact with the aqueous cleaning solution of the present invention for a time period of about 30 minutes to 12 hours, in particular for a time period of 60 minutes to 8 hours, in particular for a time period of 1.5 to 6 hours, in particular for a time period of 2 to 5 hours, in particular for a time period of 3 to 4 hours, in particular for a time period of 1.5 to 2 hours.

All individual numerical values that fall in the ranges defined above but are not explicitly mentioned here, are also intended to be encompassed by the subject-matter of the present invention.

In another specific embodiment of the process according to the present invention, the stainless metallic surfaces to be cleaned are located in process stations and/or production units, in particular process stations and/or production units operated with ultrapure water and/or ultrapure vapor, in particular with ultrapure water and/or ultrapure vapor at temperatures of more than 60° C.

For cleaning said process stations and production units, the vessels and devices to be cleaned are filled with the cleaning solution according to the present invention and the pH value is adjusted at a range of pH 4.0 to pH 8.0, in particular in a range of pH 6.0 to pH 8.0. Then the cleaning solution is allowed to react with the surface to be treated at a temperature of 50° C. to 95° C., in particular 60° C. to 90° C., in particular 70° C. to 85° C. for a time period of 1.0 h to 5 h, in particular 1.5 h to 3.0 h. The cleaning solution can e.g. be moved through the system with the help of the stirring or flowing device installed in the vessels or by means of external circulating pumps wherein slow flow rates are preferred.

All individual numerical values that fall in the ranges defined above but are not explicitly mentioned here, are also intended to be encompassed by the subject-matter of the present invention.

By periodically removing samples from the cleaning solution it can be determined, by means of known processes, whether the reducing agent is still present in an efficient concentration. For example, by using a methylene blue solution, it can easily be determined whether sufficient amounts of reducing agent are left in the cleaning solution. If this is the case, the methylene blue solution visibly decolorizes. If, on the other hand, the concentration of reducing agent is suboptimal, the methylene blue does not decolorize and more reducing agent may have to be added.

The end point of a cleaning process can be determined by means of iron content measurements (e.g. colorimetrically). If after a certain incubation time, the iron content of the cleaning solution reaches a stable value, the cleaning process can be discontinued.

For this purpose, the cleaning solution is first removed and the cleaned vessels and devices are then rinsed clean.

A repassivation of the stainless steel surfaces can be carried out using an aqueous solution comprising an oxidizing agent, in particular an oxygen-donating acid (such as e.g. $HNO_3$; <20 ppm $Cl^-$ or hydrogen peroxide), which is capable of building up the passive layer protecting the stainless steel, and optionally at least one complexing agent, and/or using oxygen-containing ultrapure water, in particular oxygen-containing ultrapure water with a conductivity of 0.5 μS/cm and at a temperature of 10° C. to 20° C., in particular 12° C. to 15° C., preferably at 14° C.

Since according to its preparation, the ultrapure water used for this purpose contains the natural load of dissolved $O_2$, the necessary passive layer rich in chromium oxide can be built up.

Finally, the surfaces are rinsed using ultrapure water in a thorough rinsing until the conductivity value has reached an acceptable value. That value is preferably <0.7 μS/cm.

If films/deposits are to be removed from parts which can be removed from the station or unit, e.g. individual sections of pipe or instruments, the process according to the present invention can also be carried out such that the dismantled parts whose films/deposits are to be removed are placed in a bath of a cleaning solution according to the present invention.

Especially good cleaning results can be obtained when a spray process is used (e.g. using spray balls, C(leaning)I(n)P (lace) spray units) which is preferably carried out in an inert atmosphere and is also encompassed by the present invention. Inert reaction conditions can be created by aerating the systems to be cleaned with inert gases such as e.g. nitrogen or noble gases.

A cleaning solution for use in the process according to the present invention comprising the composition disclosed herein is also encompassed by the present invention.

EXAMPLES

Examples which describe the effects of the process according to the present invention using the example of films/deposits of oxidic iron compounds (rouging) on the surface of stainless steels are described in more detail in the following.

Formulations

Formulation A: Powder:

| Compound | Weight percent |
|---|---|
| Sodium dithionite | 76.2 |
| Sodium hydrogencarbonate* | 23.8 |

*used synonymously with sodium dicarbonate

| Formulation B: Solution | |
|---|---|
| Compound | Weight percent |
| Potassium hydroxide | 11.7 |
| 2-Phosphonobutane1,2,4-tricarboxylic acid (50%) | 12.5 |
| N-methylglycine diacetic acid trisodium salt* (40%) | 9.3 |
| Oxalic acid (optional) (100%) | 1.2 |
| Soft water | added to complete 100% |

*used synonymously with L-alanine, N,N-bis(carboxymethyl)-, trisodium salt

For a standard batch, e.g. for a vessel cleaning, of a volume of 250 liters, 5 liters of formulation B (=2%) and 0.525 kg of formulation A (=0.21%) are needed.

Example 1

Substances/agents used: Sample plates from pipes made from stainless steel (AISI 316L) are used which were taken from a pharmaceutical pipe system for the distribution of hot ultrapure water (WFI) and which exhibit a thick oxidic iron layer (rouging).

In this example, the oxidic iron layer (rouging) chemically consists mainly of poorly soluble Fe(III) compounds.

For removing the rouging from the metal surface, a freshly prepared 3% solution of solid sodium dithionite in water which additionally comprises 5% 2-phosphonobutane-1,2,4-tricarboxylic acid sodium salt (PBTC-Na4), 3% tetrasodiumiminodisuccinate and 1% of a sodium hydrogen carbonate/carbonic acid buffer is used.

Process steps: A 4×5 cm sample plate is placed in 500 ml of the above-mentioned dithionite solution. The solution (pH value (at beginning) about 8) is stirred for 4 hours at 60 to 80° C. at a low rotor speed. After the dwell time, 10 mL of the solution are removed and analyzed with respect to its iron content.

Result: The oxidic iron layer (rouging) has been significantly reduced. Only a slight residual deposit remains. After 4 hours of dwell time, the iron content of the solution is 4.2 mg/L of iron. The pH value slightly changes during the reaction: pH (end) about 7. The result can be further improved by adding about 0.5% potassium oxalate to the above-mentioned dithionite solution.

Comparison with the previously used process: Under otherwise identical test conditions (same reaction time and temperature), a reaction solution comprising 15% phosphonic acid and 2% citric acid and exhibiting a pH of <1 shows no marked difference in the deposit on the surface. After 4 hours of dwell time, the iron content of the solution is 0.7 mg/L of iron.

Example 2

Substances/agents used: Short pipe sections from stainless steel pipes (AISI 316L) are used which were taken from a pharmaceutical pipe system for the distribution of hot ultrapure water (WFI) and which exhibit a thick oxidic iron layer (rouging).

In this example, the oxidic iron layer (rouging) chemically consists mainly of poorly soluble Fe(III) compounds.

Process steps: For removing the rouging from the metal surface, a freshly prepared 0.5% solution of solid sodium dithionite in water which additionally comprises 1% 2-phosphonobutane-1,2,4-tricarboxylic acid sodium salt (PBTC-Na4), 0.5% tetrasodiumiminodisuccinate, 0.1% potassium oxalate and 0.2% of a sodium hydrogen carbonate/carbonic acid buffer is used.

Process steps: A 5 cm wide pipe section with a 7 cm diameter is placed in 250 ml of the above-mentioned dithionite solution. The solution (pH value (at beginning) about 7.5) is stirred for 5 hours at 70° C. at a low rotor speed. After the dwell time, 10 mL of the solution are removed and analyzed with respect to its iron content.

Result: The oxidic iron layer (rouging) has been significantly reduced. Only a slight residual deposit remains in the form of black rubbings (Fe(II/III) compounds). After 5 hours of dwell time, the iron content of the solution is 21.4 mg/L of iron. The pH value slightly changes during the reaction: pH (end) about 6.5.

Example 3

Substances/agents used: A 300 liter stainless steel (AISI 316L) vessel is used which is used in pharmaceutical production and exhibits a thick oxidic iron layer (rouging). This layer can be wiped off with a white cloth and causes a strong red discoloration of the cloth after wiping.

In this example, the oxidic iron layer (rouging) chemically consists mainly of poorly soluble Fe(III) compounds.

Process steps: For removing the rouging from the vessel surface, a freshly prepared 0.25% solution of solid sodium dithionite in water which additionally comprises 0.5% 2-phosphonobutane-1,2,4-tricarboxylic acid sodium salt (PBTC-Na4), 0.25% tetrasodiumiminodisuccinate, 0.05% potassium oxalate and 0.1% of a sodium hydrogen carbonate/carbonic acid buffer is used.

Process steps: The vessel is completely filled with 300 liters of the above-mentioned dithionite solution. The solution (pH value (at beginning) about 7.5) is allowed to react for 1.5 hours at 75° C. The cleaning solution is circulated with a circulating pump. After the dwell time, 10 mL of the solution are removed and analyzed with respect to its iron content. The vessel is subsequently washed with water and a wipe test is carried out with a white cloth.

Result: The oxidic iron layer (rouging) has been completely removed. After the dwell time, the iron content of the solution is 0.65 mg/L of iron. The pH value slightly changes during the reaction: pH (end) about 7.0. After wiping off the surface of the vessel, the cloth remains completely white.

The presence of an effective concentration of dithionite can easily be verified by the decolorization of a methylene blue solution. If an insufficient amount of dithionite is present in the solution, the methylene blue does not decolorize. Thus, methylene blue is suitable for tracking the cleaning process (derouging process) by testing a pumped off sample at regular intervals.

The end point of a cleaning process (derouging process) can be determined by means of iron content measurements (e.g. colorimetrically). If after a certain dwell time, the iron content of the cleaning solution reaches a stable value, the cleaning process can be discontinued.

Example 4

Substances/agents used: A 750 liter stainless steel (AISI 316L) vessel with a CIP spray unit is used which is used in pharmaceutical production and exhibits a thick oxidic iron layer (rouging). This layer can be wiped off with a white cloth and causes a strong red discoloration of the cloth after wiping.

In this example, the oxidic iron layer (rouging) chemically consists mainly of poorly soluble Fe(III) compounds.

For removing the rouging from the vessel surface, a freshly prepared 0.25% solution of solid sodium dithionite in water which additionally comprises 0.5% 2-phosphonobutane-1,2,4-tricarboxylic acid sodium salt (PBTC-Na4), 0.25% tetrasodiumiminodisuccinate, 0.05% potassium oxalate, 0.1% oxalic acid and 0.1% of a sodium hydrogen carbonate/carbonic acid buffer is used.

Process steps: The vessel as well as the pipelines with circulating pump needed for the CIP spray unit are completely flushed with gaseous nitrogen. 150 liters of the above-mentioned dithionite solution are filled into the vessel that has been rendered inert. The solution (pH value (at beginning) about 7.5) is circulated for 45 minutes at 75° C. via the circulating pump and the pipelines. During that time, the walls of the vessel are continuously wetted with the dithionite solution via the CIP spray ball. The vessel remains inert with exposure to nitrogen throughout the entire cleaning period. After the cleaning period, 10 mL of the solution are removed and analyzed with respect to its iron content. The vessel is subsequently washed with water and a wipe test is carried out with a white cloth.

Result: The oxidic iron layer (rouging) has been completely removed. The iron content of the solution is 1.23 mg/L of iron after the dwell time. The pH value slightly changes during the reaction: pH (end) about 7.0. After wiping off the vessel surface, the cloth remains completely white.

Example 5

Examples 1-4 are repeated using formulations A and B as specified herein above with the indicated concentrations of their components.

For a standard batch, e.g. for a vessel cleaning, of a volume of 250 liters, 5 liters of formulation B (=2%) and 0.525 kg of formulation A (=0.21%) are needed.

I claim:

1. A method of using an aqueous cleaning solution comprising a reducing agent and at least one complexing agent for removing, in the neutral pH range, rouging from a surface of a stainless steel that comes in contact with media, wherein the stainless steel is selected from the group of chromium/nickel and chromium/nickel/molybdenum steels, wherein said media comprises ultrapure water having a conductivity ≦5.0 μS, ultrapure water vapor having a conductivity ≦5.0 μS, or a combination thereof, and wherein the rouging is composed of layers of oxidic iron compounds intercalated with chromium, nickel, molybdenum, or a combination thereof.

2. The method of claim 1, wherein the cleaning solution has a pH value of about pH 6.0 to about pH 8.0.

3. The method of claim 1, wherein the oxidic iron compounds are oxidically bound Fe(III).

4. The method of claim 1, wherein the rouging layer has a layer thickness of between 1 μm to 10 μm.

5. The method of claim 1, wherein the steels are those of grades AISI 304 (*1.4301), AISI 304L (1.4307, 1.4306), 303 (*1.4305), AISI 305L (1.4307, 1.4306), AISI 316 (1.4401), AISI 316L (1.4404, 1.4435), AISI 316 Ti (1.4571) and AISI 904L (1.4539) [*1.xxxx=according to DIN 10027.2].

6. The method of claim 5, wherein the steels are cold-rolled, polished, scoured or electropolished steels with a surface roughness of Ra<3.0 um.

7. The method of claim 1, wherein the ultrapure water is a. purified water (Aqua Purificata (AP)) with a conductivity of ≦4.3 μS at 20° C. (Ph. Eur.) or ≦4.70 at 25° C. (USP 25); or b. ultrapurified water (Aqua valde purificata) with a conductivity of ≦2.1 μS at 25° C.; or c. water for injection (Aqua ad iniectabilia) with a conductivity of ≦1.1 μS at 20° C. (Ph. Eur.) or ≦1.3 μS at 25° C. (USP 25).

8. The method of claim 1, wherein the cleaning solution comprises at least two different complexing agents.

9. The method of claim 8, wherein the cleaning solution additionally compromises a substance having both complexing and reducing properties.

10. The method of claim 8, wherein the reducing agent and the complexing agents are present in a concentration ratio of 0.3% reducing agent/0.6% complexing agents.

11. The method of claim 1, wherein a salt-like reducing oxygen compound is used as the reducing agent.

12. The method of claim 11, wherein the salt-like reducing agent is selected from the group consisting of; sulfur, nitrogen, and phosphorous oxygen compounds.

13. The method of claim 1, wherein an acid selected from the group of phosphonic acids, phosphonocarboxylic acids, hydroxyl acids, iminosuccinylic acids, acetic acids and citric acids or a salt thereof is used as a complexing agent.

14. The method of claim 13, wherein the phosphonic acid is selected from the group consisting of hydroxyalkanoic and alkylenephosphonic acids.

15. The method of claim 13, wherein the phosphonic acid is hydroxyethan-1,1-diphosphonic acid (HEDP), aminotri(methylenephosphonic acid) (ATMP), hexamethylenediaminotetra(methylenephosphonic acid) (HDTMP), diethylenetriaminopenta(methylenephosphonic acid) (DTPMP), 2-phosphobutane-1,2,4-tricarboxylic acid, or a salt thereof.

16. The method of claim 13, wherein a compound comprising diacetic acid groups is used as complexing agent.

17. The method of claim 16, wherein the compound is a methylglycine diacetic acid or a salt thereof.

18. The method of claim 1, wherein the reducing agent and the complexing agent are present in the cleaning solution in concentrations of 0.1 wt.-% to 1 wt.-%.

19. The method of claim 1, wherein the reducing agent and the complexing agent are present in a concentration ratio of 0.6% reducing agent/1.0% complexing agent.

20. The method of claim 1, wherein the reducing agent and the complexing agent are present in a concentration ratio of 0.3% reducing agent/0.5% complexing agent.

21. The method of claim 1, wherein the reducing agent and the complexing agent are present in a concentration ratio of 0.1% reducing agent/0.2% complexing agent.

22. The method of claim 1, wherein the reducing agent comprises dithionite, disulfite, a combination of dithionite and disulfite, or a salt thereof.

23. The method of claim 22, wherein the complexing agent comprises a phosphonic acid, a compound comprising diacetic acid groups, a combination of a phosphonic acid and a compound comprising diacetic acid groups, or a salt thereof.

24. The method of claim 1, wherein the cleaning solution comprises dithionite or a salt thereof and a combination of phosphonic acid and/or methylglycine diacetate or a salt thereof.

25. The method of claim 24, wherein the cleaning solution further comprises oxalic acid.

26. The method of claim 24, wherein the aqueous cleaning solution further comprises a buffer.

27. The method of claim 24, wherein the cleaning solution comprises a combination of dithionite and/or disulfite or a salt thereof, as well as phosphonic acid and methylglycine diacetic acid or a salt thereof.

28. The method of claim 27, wherein the aqueous cleaning solution further comprises a buffer.

29. The method of claim 27, wherein the aqueous cleaning solution further comprises oxalic acid.

* * * * *